US008960826B2

(12) United States Patent
Choo et al.

(10) Patent No.: US 8,960,826 B2
(45) Date of Patent: Feb. 24, 2015

(54) REFRIGERATOR

(71) Applicant: LG Electronics Inc., Seoul (KR)

(72) Inventors: Ayoung Choo, Changwon-si (KR); Jaeyoul Lee, Changwon-si (KR); Taegyeong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/923,606

(22) Filed: Jun. 21, 2013

(65) Prior Publication Data

US 2013/0342095 A1 Dec. 26, 2013

(30) Foreign Application Priority Data

Jun. 21, 2012 (KR) ..... 10-2012-0066866

(51) Int. Cl.

| | |
|---|---|
| ***A47B 96/04*** | (2006.01) |
| ***A47B 88/00*** | (2006.01) |
| ***A47B 77/10*** | (2006.01) |
| ***F25D 23/04*** | (2006.01) |
| ***F25D 25/02*** | (2006.01) |

(52) U.S. Cl.

CPC ..... *F25D 23/04* (2013.01); *F25D 25/027* (2013.01); *F25D 2323/023* (2013.01); *F25D 2323/024* (2013.01)

USPC ..... 312/408; 312/310; 312/313

(58) Field of Classification Search

CPC ..... F25D 23/02; F25D 23/028; F25D 23/12; F25D 25/02; F25D 25/021; F25D 25/024; F25D 25/027; F25D 25/04; F25D 2323/023

USPC ..... 312/408, 310, 313, 327, 328

See application file for complete search history.

(56) References Cited

U.S. PATENT DOCUMENTS

| | | | | |
|---|---|---|---|---|
| 1,479,721 | A * | 1/1924 | Liedtke | 312/100 |
| 2,920,914 | A * | 1/1960 | Jenkins | 292/67 |
| 3,212,835 | A | 10/1965 | Beckett et al. | 312/311 |
| 5,685,624 | A * | 11/1997 | Lee | 312/405.1 |
| 5,887,960 | A * | 3/1999 | Lee | 312/334.5 |

(Continued)

FOREIGN PATENT DOCUMENTS

| | | | |
|---|---|---|---|
| EP | 2 578 972 | A2 | 4/2013 |
| KR | 10-2007-0025481 | A | 3/2007 |

(Continued)

OTHER PUBLICATIONS

European Search Report dated Jun. 20, 2014 issued in Application No. 13 17 3000.

*Primary Examiner* — Janet M Wilkens
*Assistant Examiner* — Andrew Roersma
(74) *Attorney, Agent, or Firm* — Ked & Associates, LLP

(57) ABSTRACT

A refrigerator is provided. The refrigerator may include a cabinet having a first storage region with a plurality of shelves, a first door coupled to the cabinet by a first connection member and having a second storage region with a plurality of shelves and an opening providing to access to the second storage region, and a second door rotatably coupled to the first door by a second connection member so as to selectively provide access to the second storage region through the opening in the first door. An auxiliary shelf may be rotatably coupled in the opening formed in the first door such that an axis of rotation of the auxiliary shelf crosses, or is orthogonal to, the axis of rotation of the first and second doors.

24 Claims, 15 Drawing Sheets

(56) References Cited

U.S. PATENT DOCUMENTS

| | | | | |
|---|---|---|---|---|
| 7,430,111 | B2 * | 9/2008 | Lee et al. | 361/679.27 |
| 7,654,107 | B2 * | 2/2010 | Okuda et al. | 62/441 |
| 2001/0035024 | A1 | 11/2001 | Dasher et al. | 62/440 |
| 2006/0226750 | A1 * | 10/2006 | Lee et al. | 312/405.1 |
| 2008/0034778 | A1 * | 2/2008 | Lim et al. | 62/340 |
| 2008/0066481 | A1 * | 3/2008 | An et al. | 62/265 |
| 2009/0277209 | A1 * | 11/2009 | Jang et al. | 62/441 |
| 2010/0283368 | A1 * | 11/2010 | Lee | 312/405.1 |
| 2010/0308705 | A1 * | 12/2010 | Kwon et al. | 312/404 |
| 2012/0180395 | A1 * | 7/2012 | Yamaguchi | 49/359 |
| 2013/0119849 | A1 * | 5/2013 | Gwak | 312/405.1 |
| 2013/0147337 | A1 * | 6/2013 | Lim | 312/404 |

FOREIGN PATENT DOCUMENTS

| | | | | |
|---|---|---|---|---|
| KR | 1020080086775 | A * | 9/2008 | F16C 11/04 |
| WO | WO 2011009773 | A2 * | 1/2011 | F25D 25/02 |
| WO | WO 2011021630 | A1 * | 2/2011 | E05F 1/14 |
| WO | WO 2011/081279 | A1 | 7/2011 | |

* cited by examiner

REFRIGERATOR

CROSS-REFERENCE TO RELATED APPLICATION(S)

This application claims priority under 35 U.S.C. §119 to Korean Application No. 10-2012-0066866 filed on Jun. 21, 2012, whose entire disclosure is hereby incorporated by reference.

BACKGROUND

1. Field

This relates to a refrigerator.

2. Background

Refrigerators store items at a low temperature in an inner storage space covered by a door. Such a refrigerator may cool an inner storage space using cool air generated through heat-exchange with a refrigerant circulating through a refrigeration cycle to store items at an optimum state. In response to recent dietary and lifestyle changes, large multifunctional refrigerators have been introduced, including various structures and convenience devices, while taking into consideration user convenience and energy efficiency.

BRIEF DESCRIPTION OF THE DRAWINGS

The embodiments will be described in detail with reference to the following drawings in which like reference numerals refer to like elements wherein.

DETAILED DESCRIPTION

In the following detailed description, reference is made to the accompanying drawings that form a part hereof, and in which is shown by way of illustration various exemplary embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

A refrigerator may include a separate home bar door provided in a refrigerator door to provide convenient access to items stored in a corresponding storage space provided in the refrigerator door. Such a home bar door may be rotatably mounted in the door, in a direction crossing a rotation direction of the refrigerator door. A back surface of the home bar door may function as a shelf when opened and horizontally oriented, to receive beverages or other containers thereon. However, if the home bar door does not have a forwardly rotatable structure, but instead a different structure, a separate shelf for receiving beverages or other such containers would be advantageous. In such a structure, after the home bar door is opened, such a shelf may be withdrawn through a separate manipulation.

Figure 1:
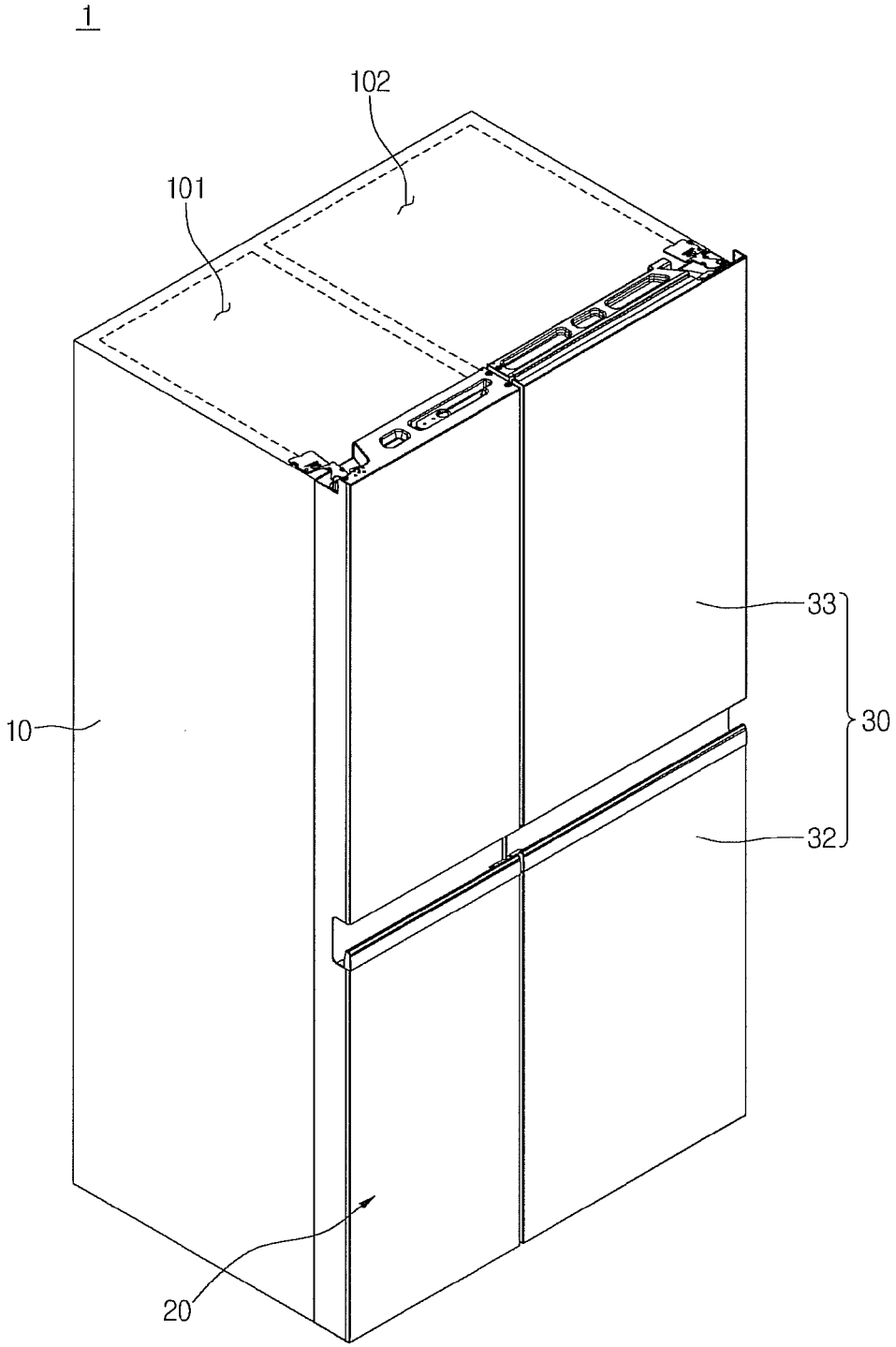
FIG. 1 is a perspective view of a refrigerator according to an embodiment as broadly described herein.
Figure 2:
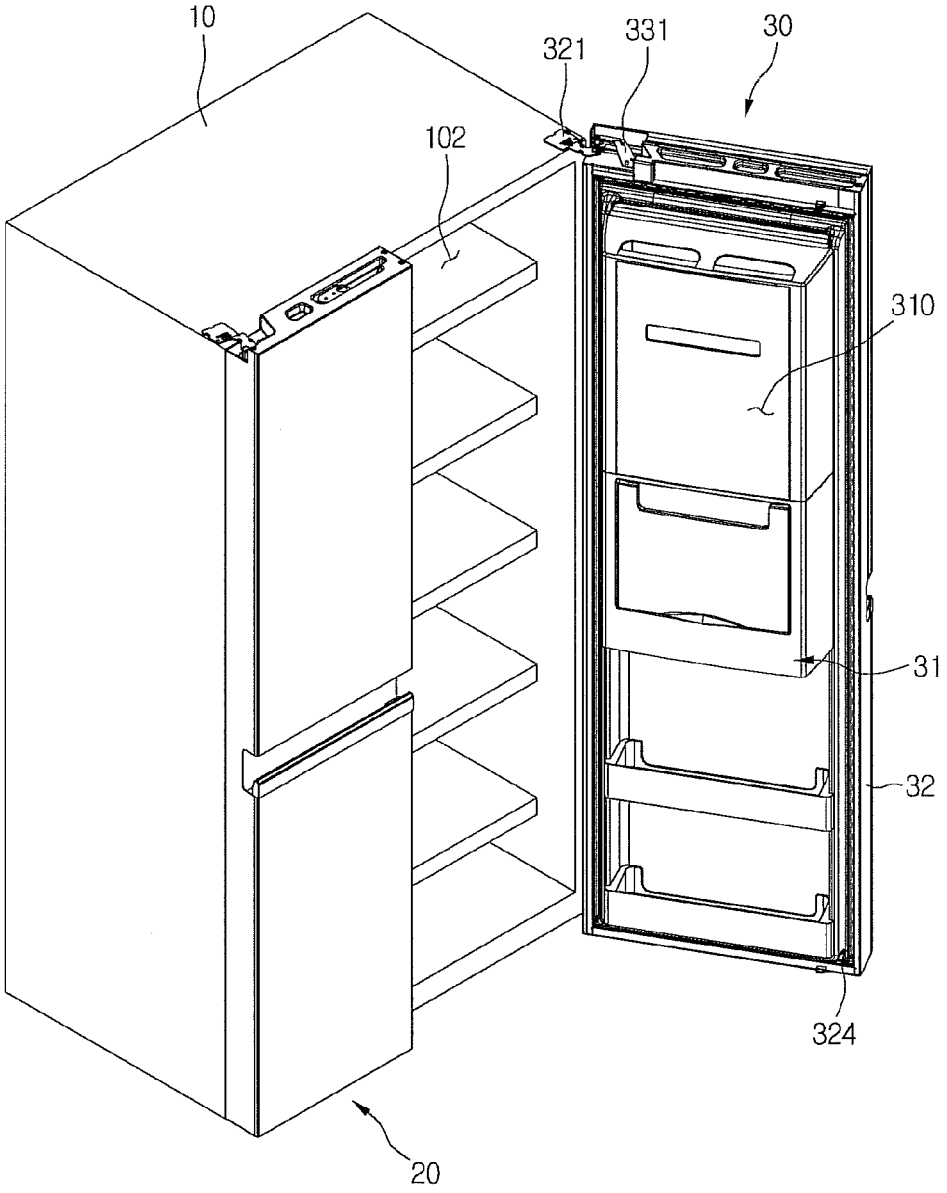
FIG. 2 is a perspective view of the refrigerator shown in FIG. 1, with a first door opened.
Figure 3:
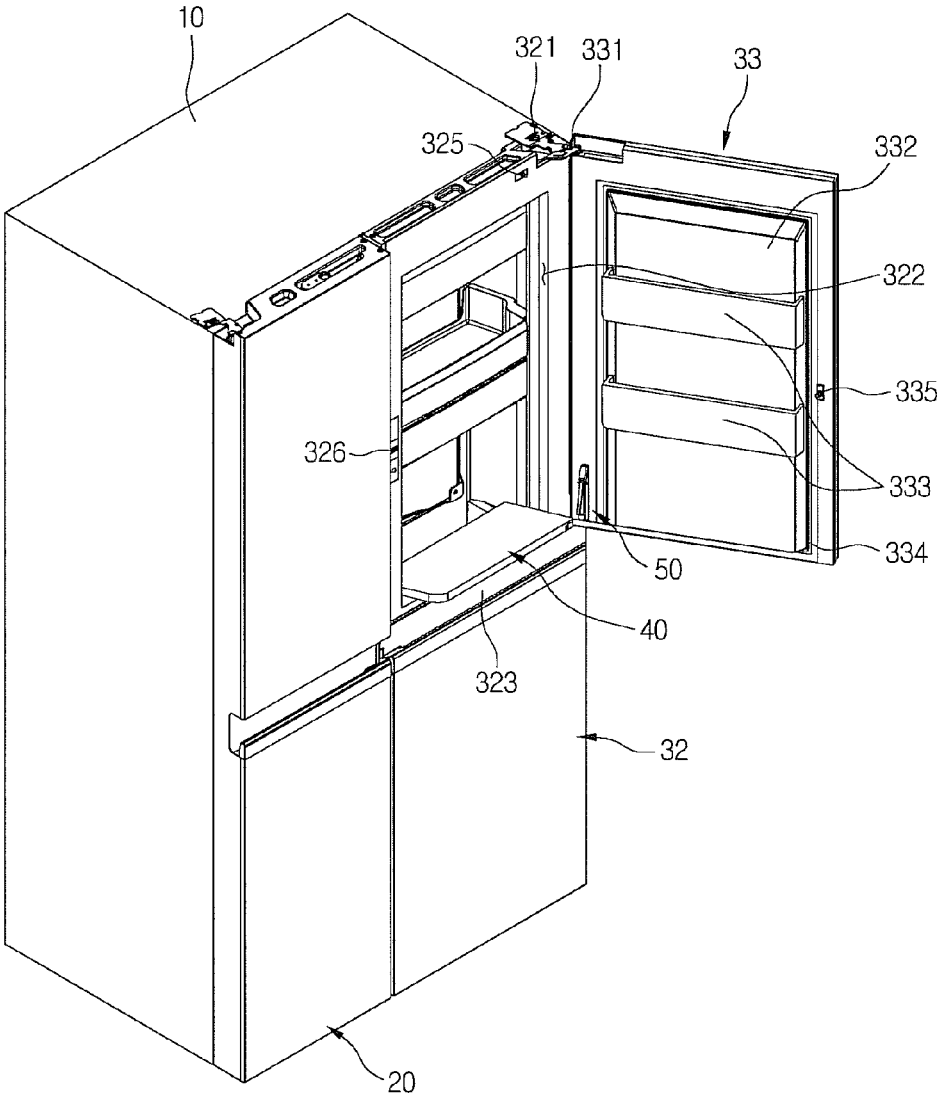
FIG. 3 is a perspective view of the refrigerator shown in FIG. 1, with a second door.

Referring to FIGS. 1 to 3, a refrigerator 1 as embodied and broadly described herein may include a cabinet 10 defining a storage space, and one or more doors for opening or closing the storage space. An external appearance of the refrigerator 1 may be defined by the cabinet 10 and the door. The inside of the cabinet 10 may be partitioned by a mullion extending across the storage space to define a freezing compartment 101 and a refrigerating compartment 102. The one or more doors may include a freezing compartment door 20 for covering the freezing compartment 101 and a refrigerating compartment door 30 for covering the refrigerating compartment 102.

An accommodation device 31 defining a space separated from the inside of the refrigerating compartment 102 may be disposed in the refrigerating compartment door 30. Thus, when the refrigerating compartment door 30 is closed, the inside of the refrigerating compartment 102 may be defined as a first storage compartment or region, and the inside of the accommodation device 31 may be defined as a second storage compartment 310 or a second storage region. As shown in FIGS. 2 and 3, the accommodation device 31 may have a structure in which a chamber is defined therein by a separate housing or cover, or a structure including a square frame having an opening therein. A plurality of shelves or drawers may be vertically disposed in such an opening. The plurality of shelves or drawers may be fixedly or detachably mounted on an inner circumferential surface of the frame. Alternatively, the plurality of shelves or drawers may be slidably mounted on the inner circumferential surface of the frame.

The refrigerating compartment door 30 may include a first door 32 for opening or closing the first storage compartment of the refrigerating compartment 102 and a second door 33 for opening or closing the second storage compartment 310.

A top surface of the first door connected to that of the cabinet 10 by a door hinge 321 so that the door 32 is rotatably coupled to the cabinet 10 by the door hinge 321. In certain embodiments, another hinge may be disposed at a lower end of the first door 32 so that the first door 32. Thus, the first door 32 may be rotated to open or close the refrigerating compartment 102.

A grip 323, or handle, for opening the first door 32 may be horizontally disposed on a front surface corresponding to an approximately central portion of the first door 32. Another grip having substantially the same shape as the grip 323 may also be horizontally disposed on a front surface of the freezing compartment door 20. When the freezing compartment door 20 and the first door 32 are closed, the grips may be disposed along the same line. The grip 323 may be recessed or stepped by a predetermined depth from the front surface of the first door 32.

A stepped surface may be defined on an upper portion of the front surface of the first door 32, and an opening 322 may be defined in the stepped surface. In detail, a lower end of the stepped surface may extend from an upper end of the grip 323 to an upper end of the first door 32. Also, the lower end of the stepped surface may have the same width as that of the first door 32. Alternatively, the stepped surface may protrude slightly forward from the grip 323.

The opening 322 may be defined in the stepped surface and have a size less than that of the stepped surface. The accommodation device 31 may be disposed on a back surface of the first door 32 corresponding to a rear side of the opening 322. The accommodation device 31 may have an opened front surface. Thus, access into the accommodation device 31 may be enabled through the opening 322.

The second door 33 may be disposed on the stepped surface. The second door 33 may be rotatably coupled to the first door 32, and may have the same size as that of the stepped surface. Thus, a lower end of the second door 33 may be positioned spaced apart from the upper end of the grip 323 to define a space through which the user may insert a hand into the grip 323.

A seal 324 contacting a circumference of a front surface of the cabinet 10 when the first door 32 is closed may be disposed on a peripheral portion of the back surface of the first door 32. The seal 324 may be formed of an electrically deformable material and thus be compressible. A magnet may be disposed within the seal 324 so that the seal 324 may be closely attached to the cabinet 10.

The opening 322 may provide access to items accommodated within the accommodation device 31 when the first door 32 is closed. Thus, the opening 322 may be opened in a state where the first door 32 covers the refrigerating compartment 102 and the second door 33 is rotated away from the first door 32 to expose the opening 322.

The opening 322 may have a size corresponding to a front portion of the accommodation device 31. The opening 322 may be vertically defined over a position of the grip 323 of the first door 32 and horizontally between left and right ends of the first door 32. Thus, the opening 323 may correspond to an upper region of the refrigerating compartment door 30. Therefore, the home bar according to the current embodiment may be significantly different in size and usability from a home bar used in a general refrigerator.

The grip 323 may be recessed further downward to allow the user to more easily grasp the grip 323 behind the rearwardly recessed portion of the grip 323. As described above, the grip 323 may be applied to the freezing compartment door 20 in the same shape as that of the refrigerating compartment door 30. When viewed from a front side, a left end and a right end of the grip 323 may have the same height. Thus, although the second door 33 is disposed on the refrigerating compartment door 30, when viewed from the front side, the refrigerating compartment door 30 and the freezing compartment door 30 may appear to be uniform.

The second door 33 may be configured to open or close the opening 322. The second door 33 may be rotatably mounted on the first door 32 by an upper hinge 331. The two opposite ends of the upper hinge 331 may be coupled to a top surface of the first door 32 and a top surface of the second door 33, respectively. In detail, the upper hinge 331 may have one end fixed to the top surface of the first door 32 and the other end through which a hinge shaft passes and is inserted into the top surface of the second door 33. Thus, the second door 33 may rotate with respect to the first door 32 about the hinge shaft of the upper hinge 331. Also, the hinge shaft serving as the rotation center of the first door 32 and the hinge shaft serving as the rotation center of the second door 33 may be provided as a single shaft or separate shafts.

A lower hinge 328 may be further provided at a lower end of the second door 33. The lower hinge 328 may be inserted into the lower end of the second door 33 and supported by a lower hinge bracket fixed to a lower end of the stepped surface of the first door 32. In certain embodiments, the lower hinge 328 may have a cam structure or a spring structure so that the second door 33 is more smoothly opened or closed.

The first door 32 and the second door 33 may independently rotate with respect to each other. Thus, the first door 32 and the second door 33 may be independently manipulated to selectively open or close the refrigerating compartment 102 and the opening 322. Since the hinge shafts serving as the rotation centers of the first and second doors 32 and 33 may be provided as a single shaft or disposed adjacent to each other, the first and second doors 32 and 33 may be opened or closed by rotating in the same direction.

The front surface of the second door 33 may be formed of the same material as those of the first door 32 and the refrigerating compartment door 20 to provide a continuous design or pattern. Also, the front surface of the second door 33 may be flush with that of the refrigerating compartment door 30 below the second door 33 when the second door 33 is closed.

When the second door 33 is closed, the top surface and left and right surfaces of the second door 33 may be flush with those of the first door 32. Also, the lower end of the second door 33 may extend up to a position corresponding to the region in which the grip 323 of the refrigerating compartment door 30 is disposed. That is, the lower end of the second door 33 may extend down to a position corresponding to the stepped portion of the region in which the grip 323 is disposed. Thus, when the second door 33 is closed, the second door 33 may appear integrated with the first door 32. When viewed from the front side, a sense of unity may be provided so that connection portions on which the second door 33 is disposed are not visible.

When the first door 32 and the second door 33 are closed, when viewed from the front side, the front surfaces of the refrigerating compartment door 30 and the freezing compartment door 20 may have substantially the same shape, the second door 33 is not easily distinguishable as separate from the first door 32, and the first and second doors 32 and 33 as one door.

A recessed portion 332 of the back surface of the second door 33 may be recessed in a shape corresponding to that of the opening 322 so that when the second door 33 is closed, the recessed portion 332 may be received in/aligned with the opening 322 to prevent cool air from leaking through the opening 322.

An accommodation space 333 may defined in the recessed portion 332 of the back surface of the second door 33. A separate basket may be attached to the accommodation space 333 to form a pocket. A gasket 334 may extend along an edge of the recessed portion 332. The gasket 334 may be formed of an elastically deformable material such as rubber or silicon. When the second door 33 is closed, the gasket 334 may be closely attached to the stepped surface corresponding to the edge of the opening 322. The gasket 334 may be pressed between the first and second doors to also prevent cool air within the accommodation device 31 from leaking.

A door switch 325 for detecting an opening/closing of the second door 33 may be disposed on a front surface of an upper end of the first door 32, i.e., an upper region of the stepped surface. The door switch 325 may output an external alarm signal when the second door 33 is not closed, for example, within a predetermined amount of time.

A locking device may be provided between the front surface of the edge of the first door 32 opposite the rotation shaft of the second door 33 and the back surface of the edge of the second door 33 to maintain the closed state of the second door 33. A restricted state of the locking device may be selectively released by, for example, a pushing manipulation thereof to open the second door 33.

The locking device may be, for example, a general push switch. The locking device may include a latch hook 335 disposed on the second door 33 and a latch slot 326 defined in a side of the first door 32 corresponding to the latch hook 335 and in which the latch hook 335 is inserted. When the second door 33 is closed, the front surface of the second door 33 may be pushed to release the latch hook 335 and the latch slot 326. Similarly, the second door 33 may be pushed against the first door 32 to engage the latch hook 335 and the latch slot 326

An auxiliary shelf 40 may be provided at a lower end of the opening 322. The auxiliary shelf 40 may be rotatably mounted at the lower end of the opening 322. When the second door 33 is closed, the auxiliary shelf 40 may be rotated and folded. When the second door 33 is opened, the auxiliary shelf 40 may be rotated and unfolded. The auxiliary shelf 40 may have a horizontal length corresponding to a horizontal width of the opening 322. When the auxiliary shelf 40 is unfolded, the auxiliary shelf 40 may have a length which protrudes forward to pass through the opening 322, thereby providing a receiving surface on which items may be temporarily stored.

Figure 4:
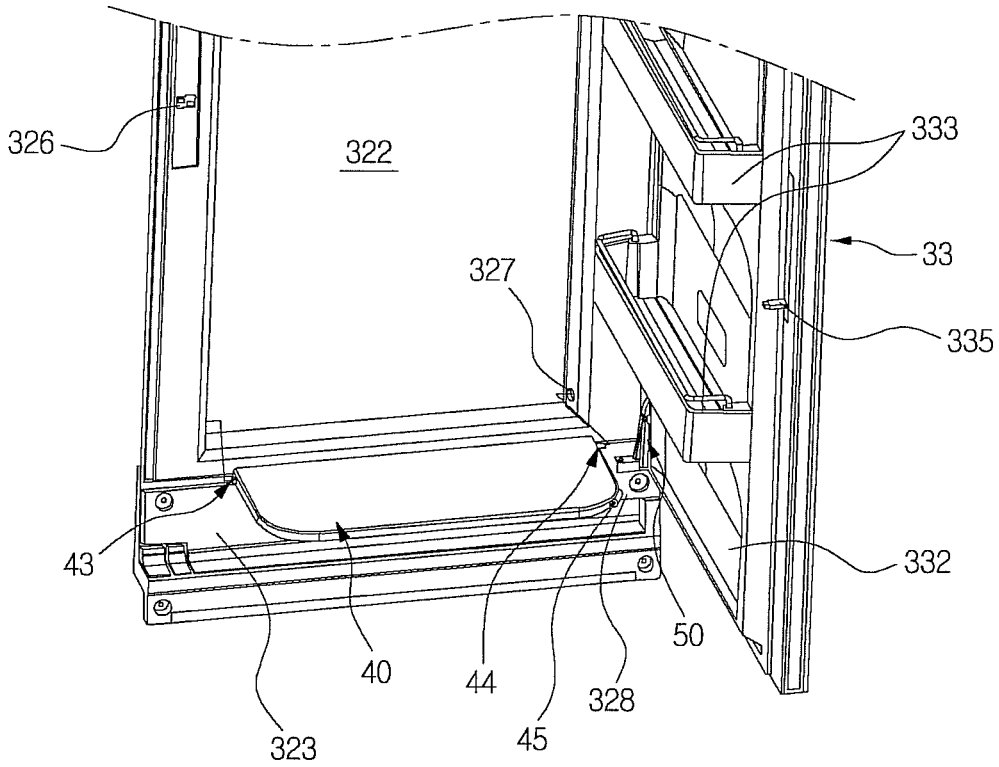
FIG. 4 is an exploded perspective view of a mounting structure of an auxiliary shelf of a refrigerator, according to an embodiment as broadly described herein.
Figure 5:
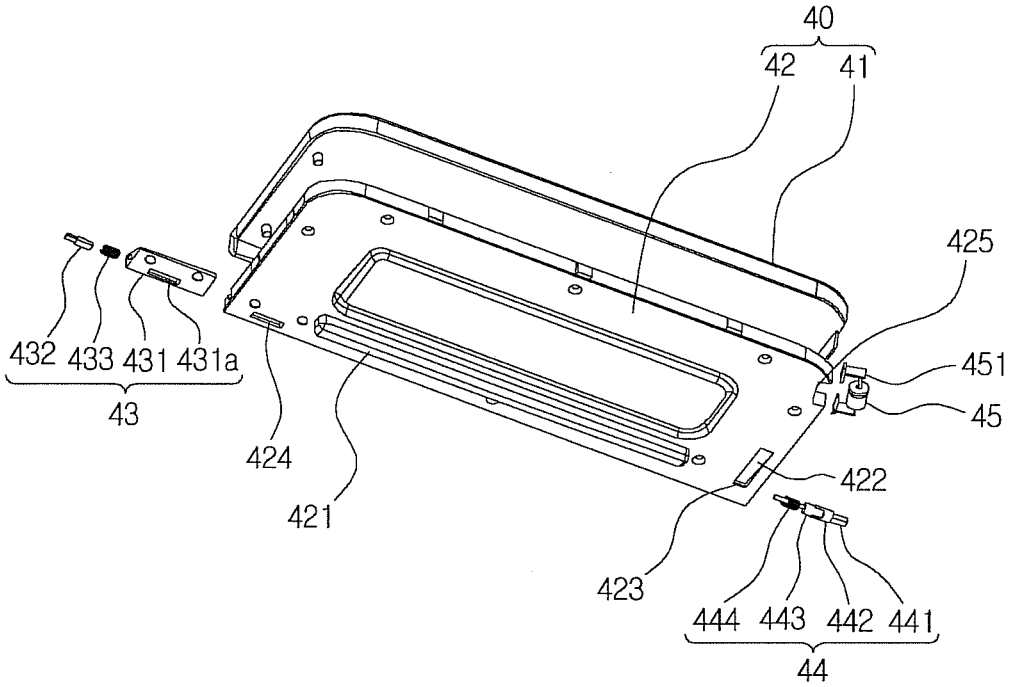
FIG. 5 is an exploded perspective view of the auxiliary shelf.

FIG. 4 is an exploded perspective view illustrating a mounted structure of the auxiliary shelf according to an embodiment, and FIG. 5 is an exploded perspective view of the auxiliary shelf.

Referring to FIGS. 4 and 5, the auxiliary shelf 40 may include an upper plate 41 defining an outer appearance of a top surface thereof and a lower plate 42 defining an outer appearance of a bottom surface thereof. A shelf hinge assembly 43/44 may be respectively disposed on two opposite sides of the auxiliary shelf 40. The shelf hinge assembly may be inserted into a hinge hole 327 defined in an inner surface of the opening 322 to allow the auxiliary shelf 40 to rotate. A guide roller 45 may contact a shelf guide 50 when the second door 33 is opened.

In detail, the upper plate 41 may define the top surface of the auxiliary shelf 40 when the auxiliary shelf 40 is unfolded. An edge portion of the upper plate 41 may have a plate shape with bent edges. The receiving surface of the upper plate 41 may be planar to receive items thereon.

The lower plate 42 may define the bottom surface of the auxiliary shelf 40. The lower plate 42 may have a shape, or contour, corresponding to that of the upper plate 41. An edge of the lower plate 42 may be bent upward and closely attached to the bent portion of the edge of the upper plate 41. Thus, a predetermined space may be defined between the lower plate 42 and the upper plate 41. However, the bent portion of the edge of the lower plate 42 may be disposed inside the bent portion of the edge of the upper plate 42. As a result, the space defined between the upper plate 41 and the lower plate 42 may have a height corresponding to a length of the bent portion of the edge of the upper plate 41.

A shelf support 421 may protrude downward from the lower plate 42. The shelf support part 42 may contact and hang on an edge of the lower end of the opening when the auxiliary shelf 40 is unfolded. Thus, the auxiliary shelf 40 may be supported by the shelf support 421 so that the auxiliary shelf 40 does not droop downward and is maintained in a horizontal state.

A shelf groove 422 may be defined in the bottom surface of the lower plate 42 adjacent to the shelf guide 50. The shelf groove 422 may have a recessed shape to accommodate a portion of the shelf guide 50 when the second door 33 is completely closed. A contact part 423 may be disposed at a lower end of the shelf groove 422 at a position slightly higher than that of a lower end of a guide lever 52 or inclined upward to a position slightly higher than that of the lower end of the guide lever 52 when the guide lever 52 protrudes from the shelf guide 50.

Thus, the contact part 423 of the shelf groove 422 and the lower end of the guide lever 52 contact each other while the second door 33 is closed. Also, the guide lever 52 may be pushed upward while being pressed by the contact part 423. When the second door 33 is completely closed, the guide lever 52 may be fully inserted into a guide cover 51.

The shelf hinge assembly may be disposed in the space between the upper plate 41 and the lower plate 42. Since a hinge shaft 441 of a damping hinge 44 protrudes outside the shelf hinge assembly and then is inserted into the hinge hole 327, the auxiliary shelf 40 may be rotatably mounted in the opening 322. In detail, the shelf hinge assembly may include a sliding hinge 43 installed at one of a left side or a right side of the auxiliary shelf 40 and a damping hinge 44 mounted on the other of the left side or the right side.

The sliding hinge 43 may be configured so that the hinge shaft 432 of the sliding hinge 43 is withdrawn or inserted through a hinge slot 424 defined in the lower plate 42. For this, the sliding hinge 43 may include a hinge body 431 defining an outer appearance thereof, a hinge shaft 432 protruding outward from the inside of the hinge body 431, and a hinge spring 433 supporting the hinge shaft 432 inside the hinge body 431. A portion of the hinge shaft 432 disposed within the hinge body 431 may pass through a hole 431*a* defined in the hinge body 431 and thus be exposed to the outside. For this, the hinge spring 433 and the hinge shaft 432 may be successively inserted into the hinge body 431, and then, the portion of the hinge shaft 432 may be exposed to the outside through the hole 431*a* and the hinge slot 424. To expose the portion of the hinge shaft 432 to the outside, the hinge slot 424 and the hole 431*a* may be aligned with each other when the hinge body 431 is assembled with the auxiliary shelf 40.

As described above, to mount the auxiliary shelf 40, a rod-shaped tool having an appropriate thickness to be inserted into the hinge slot 424 and the hole 431*a*, is inserted into the hinge slot 424 and then slidably moves the hinge shaft 432. Thus, a protruding end of the hinge shaft 432 is inserted into the hinge body 431, and in this state, the auxiliary shelf 40 is inserted into the opening 322. Then, when a force restricting the hinge shaft 432 is removed, the end of the hinge shaft 432 protrudes from the hinge body 431 and is inserted into the hinge hole 327. A process for separating the auxiliary shelf 40 may be the same as the above-described process. That is, the end of the hinge shaft 432 which is inserted into the hinge hole 327 by slidably moving the hinge shaft 432 is separated from the hinge hole 327, and then, the auxiliary shelf 40 is separated.

The damping hinge 44 may be mounted at the opposite side of the auxiliary shelf 40 to provide a rotation force to the auxiliary shelf 40. Thus, when the second door 33 is opened, the auxiliary shelf 40 may be opened at a constant speed. The sliding hinge 43 and the damping hinge 44 may be exchanged in position. That is, the damping hinge 44 may be mounted on a left side of the auxiliary shelf 40, and the sliding hinge 43 may be mounted on the right side of the auxiliary shelf 40.

In detail, the damping hinge 44 may include a hinge shaft 441, a fixed cam 442 connected to a side of the hinge shaft 441, and a movable cam 443 having a cam surface corresponding to the fixed cam 442 and supported by a damping spring 444. The damping spring 444 may be pressed or extended by an axial movement of the movable cam 443. Here, the movable cam 443 may move only in the axial direction, but may not rotate together with the hinge shaft 441 so that the movable cam 442 is maintained in a fixed state. On the other hand, the fixed cam 443 may not move in the axial direction, but may rotate only together with the hinge shaft 441.

In more detail, when the auxiliary shelf 40 rotates in a folded direction thereof, i.e., in an upright standing direction, the hinge shaft 441 and the fixed cam 442 rotate together. Also, the movable cam 443 contacting the cam surface of the fixed cam 442 moves in the axial direction of the hinge shaft 441 along the cam surface of the fixed cam 442. Particularly, the movable cam 443 moves in a direction in which the damping spring 444 is pressed. Thus, when the second door 33 is fully closed, the damping spring 444 may be maximally pressed by the movable cam 443.

In this state, when the second door 33 pushing the auxiliary shelf 40 is opened, the movable cam 443 may push the fixed cam 442 by a restoring force of the damping spring 444. Thus, the fixed cam 442 rotates along the cam surface of the movable cam 443. As a result, the hinge shaft 441 may also rotate together with the fixed cam 442, and then the auxiliary shelf 40 may automatically rotate to the unfolded position.

The damping hinge 44 may be mounted in the space between the upper plate 41 and the lower plate 42. Alternatively, the damping hinge 44 may be mounted in the space between the upper plate 41 and the lower plate 42 with the damping hinge 44 is accommodated in a separate case.

The guide roller 45 may be mounted on a right edge of the front end of the auxiliary shelf 40. The guide roller 45 may be disposed at a position contacting the shelf guide 50 when the second door 33 is opened. A roller mount 425 may be recessed in the edge of the auxiliary shelf 40, and a bracket 451 may be mounted on the roller mount 425. The bracket 451 may be configured to rotatably couple the guide roller 45 to the auxiliary shelf 40.

The shelf guide 50 may be disposed on the back surface of the second door 33. The shelf guide 50 may contact the auxiliary shelf 40 to open or close the auxiliary shelf 40 when the second door 33 is opened or closed. The shelf guide 50 may be disposed on a lower portion of the second door 33 which contacts the guide roller 45 when the second door 33 is opened or closed.

Figure 6:
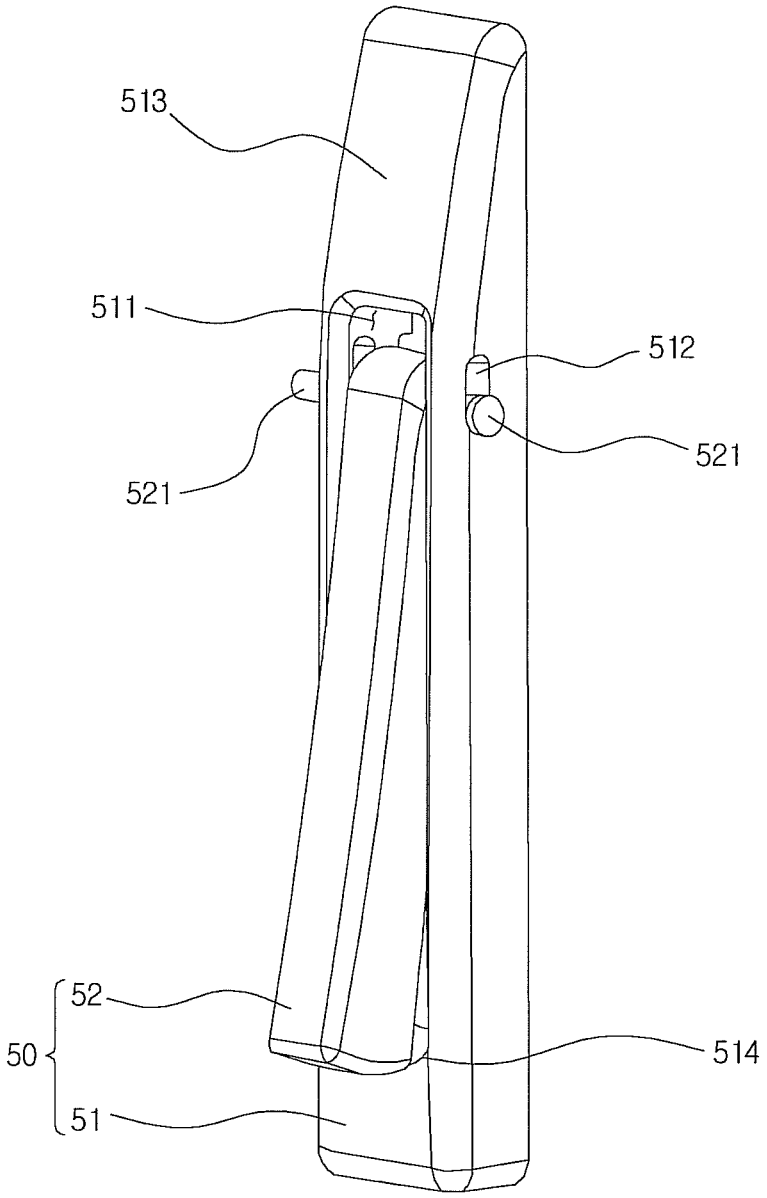
FIG. 6 is a front perspective view of a shelf guide for the auxiliary shelf, according to an embodiment as broadly described herein.
Figure 7:
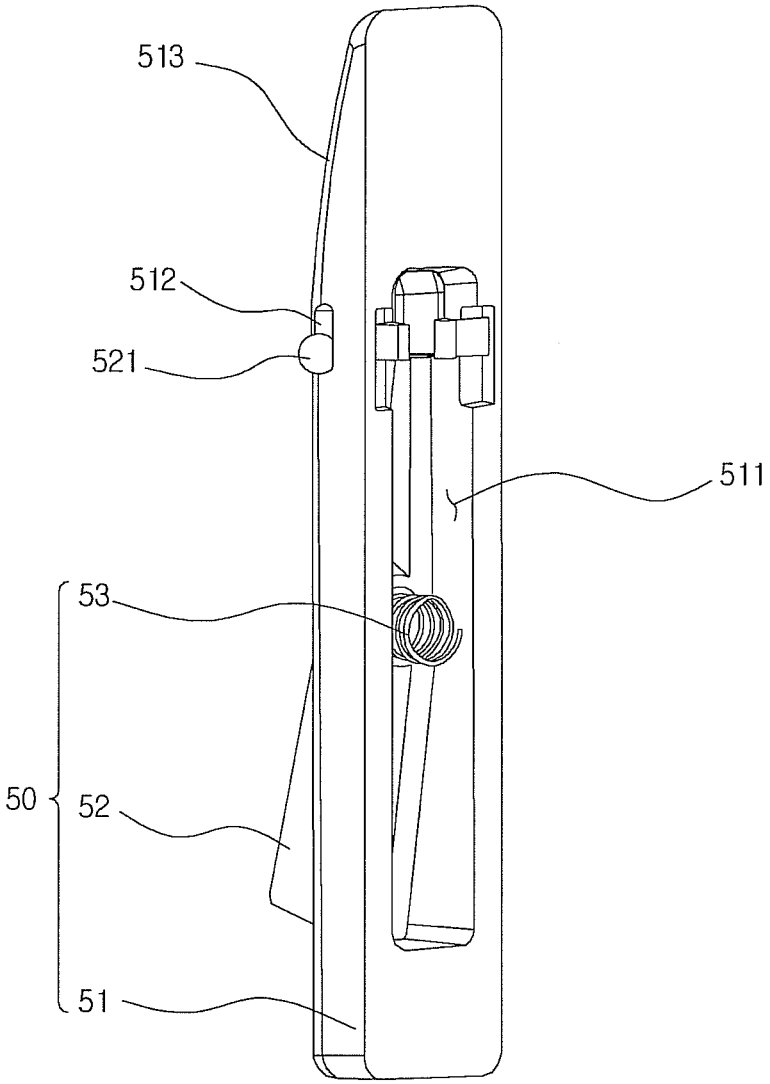
FIG. 7 is a rear perspective view of the shelf guide shown in FIG. 6.

FIG. 6 is a front perspective view of a shelf guide according to an embodiment, and FIG. 7 is a rear perspective view of the shelf guide.

Referring to FIGS. 6 and 7, the shelf guide 50 may be disposed on the back surface of the second door 33. The shelf guide 50 may include a guide cover 51 defining an outer appearance thereof, a guide lever 52 rotatably coupled to the guide cover 51, and a lever spring 53 elastically supporting the guide lever 52.

A cover opening 511 for mounting the guide lever 52 may be defined in the guide cover 51. The cover opening 511 may have a shape corresponding to that of the guide lever 52. The cover opening 511 passes through the guide cover 51 in front and rear directions and may be defined in a front surface of the guide cover 51. In certain embodiments, a recess may be formed in the front surface of the guide cover 51 instead of the cover opening 511. A side hole 512 may be defined in each of left and right surfaces of the guide cover 51. A lever shaft 521 serving as a rotation shaft of the guide lever 52 may be inserted into the side hole 512. The side hole 512 may be vertically elongated by a predetermined length. Thus, the guide lever 52 may be rotatably and vertically movably coupled to the guide cover 51.

An inclined surface 513 inclined at a predetermined angle may extend from an upper portion of the cover opening 511 up to an upper end of the guide cover 51. When the auxiliary shelf 40 rotates while the second door 33 is opened, the guide roller 45 may roll along the inclined surface 513. When the second door 33 is further opened to fully unfold the auxiliary shelf 40, the guide roller 45 may successively pass the inclined surface 513 and the guide lever 52.

The guide lever 52 may have a length corresponding to that of the cover opening 511 so that the guide lever 52 is inserted into the guide cover 51. The portion of the guide lever 52 contacting the guide roller 45 may have a flat front surface. Also, the guide roller 45 may have a circumferential surface bent backward and having a predetermined thickness. An upper end of the guide lever 52 may have a width less than that of a lower end thereof to prevent the guide lever 52 from interfering with an edge of the cover opening 511 when the guide lever 52 is inserted into the cover opening 511 while rotating.

The lever shaft 521 disposed at the upper end of the guide lever 52 may serve as a rotation center of the guide lever 52. The lever shaft 521 may pass through left and right surfaces of the guide lever 52 and then through the side holes 512. The lever shaft 521 may be integrated with the guide lever 52. Alternatively, the lever shaft 521 may be coupled to the guide lever 52 as a separate part.

The lever spring 53 may be disposed at a position spaced a predetermined distance downward from a back surface of the guide lever 52, i.e., the lever shaft 521. The lever spring 53 may support the guide lever 52 from a rear side. When an external force is not applied to the guide lever 52, the lever spring 53 may push the guide lever 52 in a front direction. Thus, when the external force is not applied to the guide lever 52, a lower end of the guide lever 52 may protrude from the front surface of the guide cover 51 by an elastic force of the lever spring 53. In addition, the lever shaft 521 may be disposed on a lower end of the guide hole 512 by a self-weight of the guide lever 52.

In this state, when the second door 33 is opened, a force pushing the guide lever 52 downward from an upper side may act by the guide roller 45. Here, the guide lever 52 may descend until the lever shaft 521 is disposed at the lower end of the side hole 512. As a result, the back surface of the lower end of the guide lever 52 may hang on a lower end of the cover opening 511 to prevent the guide lever 52 from being inserted into the cover opening 511. That is, the lower end of the guide lever 52 may be disposed at a position lower than that of the cover opening 511.

Figure 8:
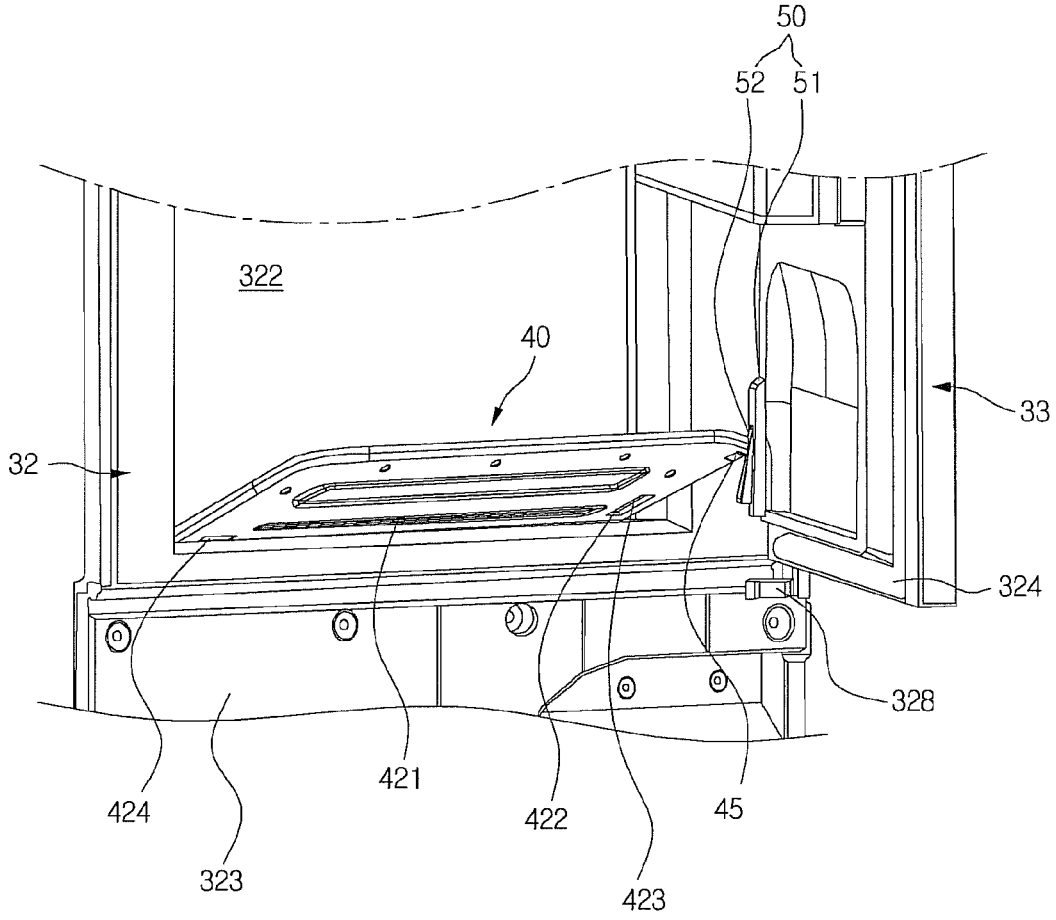
FIG. 8 illustrates rotation of the auxiliary shelf.

FIG. 8 is a perspective view of a state in which the auxiliary shelf is opened to rotate at a predetermined angle.

Referring to FIG. 8, when the second door 33 is closed, the auxiliary shelf 40 may be closely attached to the back surface of the second door 33, with the auxiliary shelf 40 folded and the bottom surface of the auxiliary shelf 40, i.e., the lower plate 42 facing front. In this state, the auxiliary shelf 40 does not move, even if the first door 32 rotates.

The user may push the front surface of the closed second door 33 to release the restriction of the latch hook 335, thereby opening the second door 33. While the restraint of the latch hook 335 is released, the second door 33 rotates about the upper hinge 321 and the lower hinge 328 relative to the first door 32, which remains closed against the cabinet 10. While the second door 33 is opened, the auxiliary shelf 40 rotates by the damping hinge 44 as shown in FIG. 8. When the second door 33 is fully opened, the auxiliary shelf 40 may be fully unfolded as shown in FIG. 3, and the auxiliary shelf 40 may be maintained in a completely horizontal state by the shelf support part 421.

When the second door 33 is fully opened, and the auxiliary shelf 40 is fully unfolded, items may be withdrawn from the storage space through the opening 322 and received on the auxiliary shelf 40.

When the second door 33 is to be closed, and is rotated at an angle greater than a preset angle, the shelf guide 50 and the guide roller 45 contact each other. Here, the guide roller 45 may contact the lower end of the guide lever 52. As the second door 33 rotates and is further closed, the guide roller 45 may move along the front surface of the guide lever 52. Then, the auxiliary shelf 40 may smoothly rotate and be gradually closed. When the second door 33 is fully closed, the back surface of the auxiliary shelf 40 contacts the guide lever 52. Thus, the guide lever 52 may be disposed inside the guide cover 51 and in the shelf groove 422 of the auxiliary shelf 40.

Figure 9:
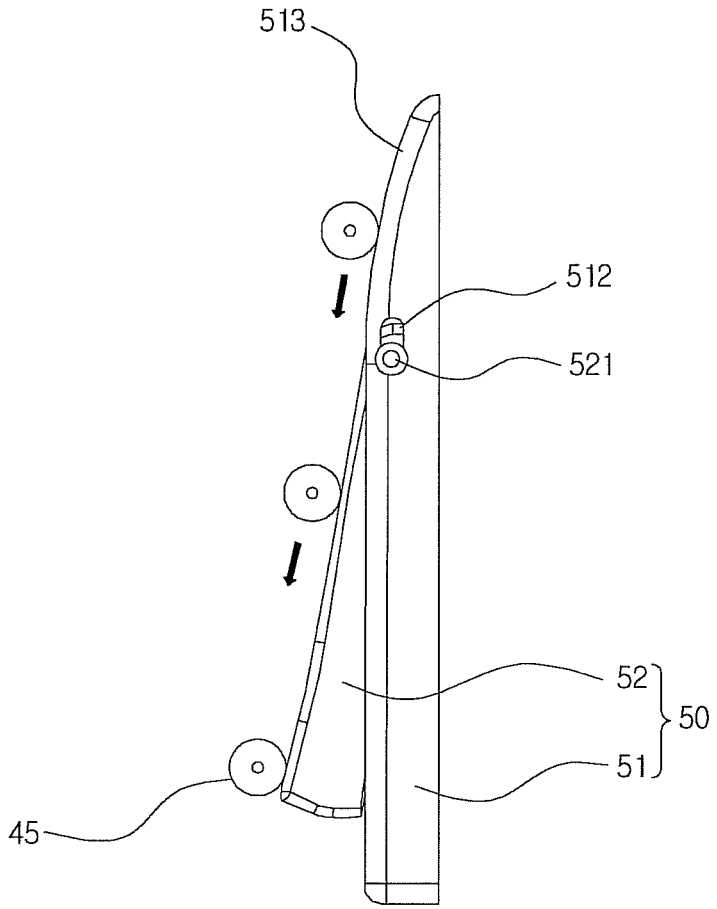
FIG. 9 is a side view of the shelf guide when the auxiliary shelf is unfolded.
Figure 10:
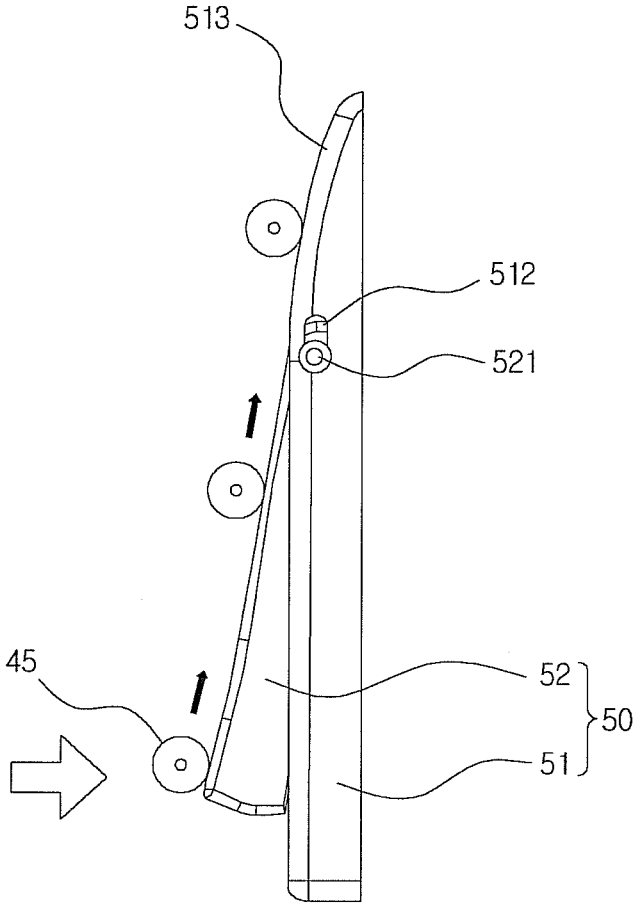
FIG. 10 is a side view of the shelf guide when the auxiliary shelf is folded.
Figure 11:
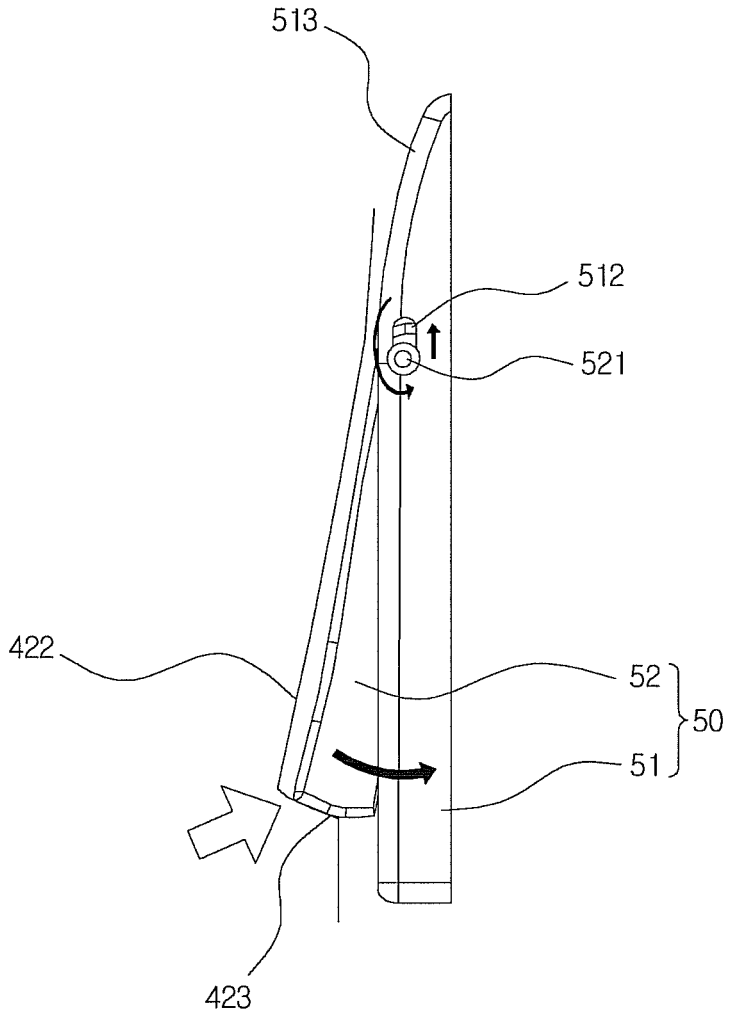
FIGS. 11 and 12 are side and perspective views of contact between the auxiliary shelf and the shelf guide when a second door is closed.
Figure 12:
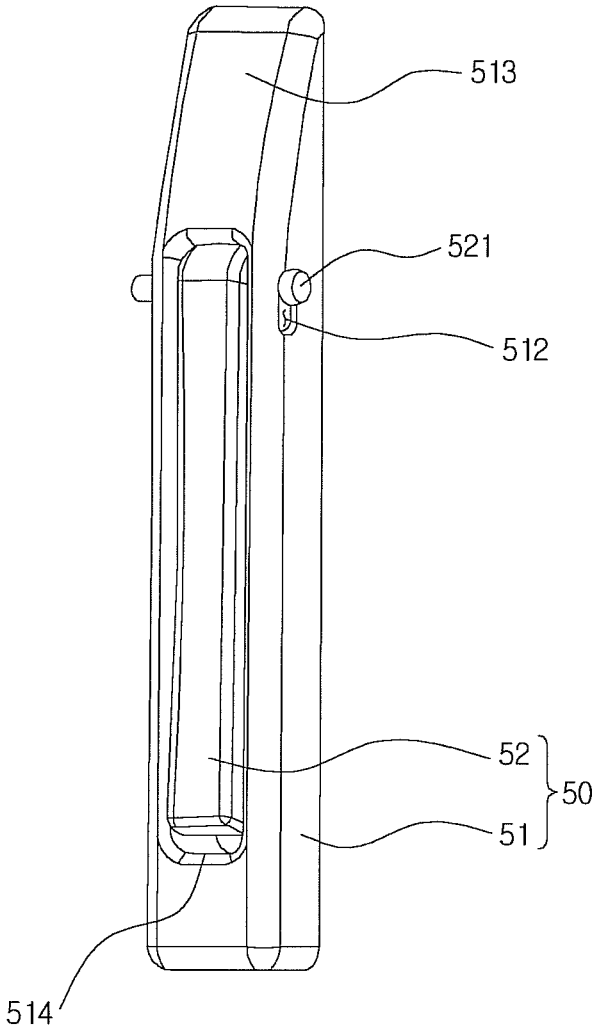

FIG. 9 is a side view illustrating a state of the shelf guide when the auxiliary shelf is unfolded, FIG. 10 is a side view illustrating a state of the shelf guide when the auxiliary shelf is folded, and FIGS. 11 and 12 are side and perspective views of a state in which the auxiliary shelf and the shelf guide contact each other when a second door is closed.

Referring to FIGS. 9 to 12, when the auxiliary shelf 40 is unfolded by the opening of the second door 33, the guide roller 45 of the auxiliary shelf 40 may first contact the inclined surface 513 of the guide cover 51 and then move along the inclined surface 513 and downward from a top surface of the guide lever 52. While the second door 33 is slowly opened, the guide roller 45 moves along the shelf guide 50 as shown in FIG. 9. As a result, the auxiliary shelf 40 may also be smoothly unfolded according to the opening speed of the second door 33.

On the other hand, in a case in which the user quickly rotates and opens the second door 33, the auxiliary shelf 40 may not contact the shelf guide 50 and also be rotated and unfolded at a predetermined speed based on the rotation force provided from the damping hinge 44.

When the second door 33 is open while the auxiliary shelf 40 is fully unfolded, the second door 33 may rotate at a preset angle as shown in FIG. 10, and then, the guide roller 45 may first contact the lower end of the guide lever 52.

Here, the lever shaft 521 of the guide lever 52 may be disposed on the lower end of the side hole 512, and the back surface of the lower end of the guide lever 52 may be hung on the front surface of the guide cover 51 corresponding to the lower end of the cover opening 511. In this state, when the second door 33 further rotates, the guide roller 45 ascends along the front surface of the guide lever 52. Finally, while the guide roller 45 moves upward along the inclined surface 513 of the guide cover 51, the auxiliary shelf 40 may be folded.

When the second door 33 further rotates and is closed with the guide roller 45 at the upper end of the shelf guide 50, as shown in FIG. 11, the lower end of the guide lever 52 contacts the lower end of the shelf groove 422 defined in the bottom surface 42 of the auxiliary shelf 40. Here, the contact part 423 disposed in the shelf groove 422 presses the lower end of the guide lever 52 in a direction in which the guide lever 52 is pushed upward from a lower side. The pressing force may be applied at an incline to the guide lever 52 in a direction between a 12 o'clock direction and a 3 o'clock direction.

Thus, when the guide lever 52 contacts the contact part 423 of the shelf groove 422, the guide lever 52 may be pressed while being pushed upward, and ascend. As a result, the lever shaft 521 of the guide lever 52 may move to the upper end of the side hole 512. In this state, when the second door 33 is fully closed, the guide lever 52 rotates with respect to a center of the lever shaft 521 and then is inserted into the cover opening 511 as shown in FIG. 12. Also, the front surface of the guide lever 52 slightly protruding from the front surface of the guide cover 51 may be disposed within the shelf groove 422. Here, the lower end of the guide lever 52 may be disposed at a position higher than that of the cover opening 511.

Embodiments different from the foregoing may be applied to a refrigerator as broadly described herein. For example, a refrigerator according to another embodiment may include an auxiliary shelf 40 that is rotatably mounted in an opening by a separate shelf bracket disposed in the opening. Such a refrigerator may be substantially equal to the refrigerator according to the foregoing embodiment except for the shelf bracket and a shelf guide. Detailed descriptions with respect to the same constitution will be omitted to prevent duplicated description, and the same elements will be denoted by the same reference numeral.

Figure 13:
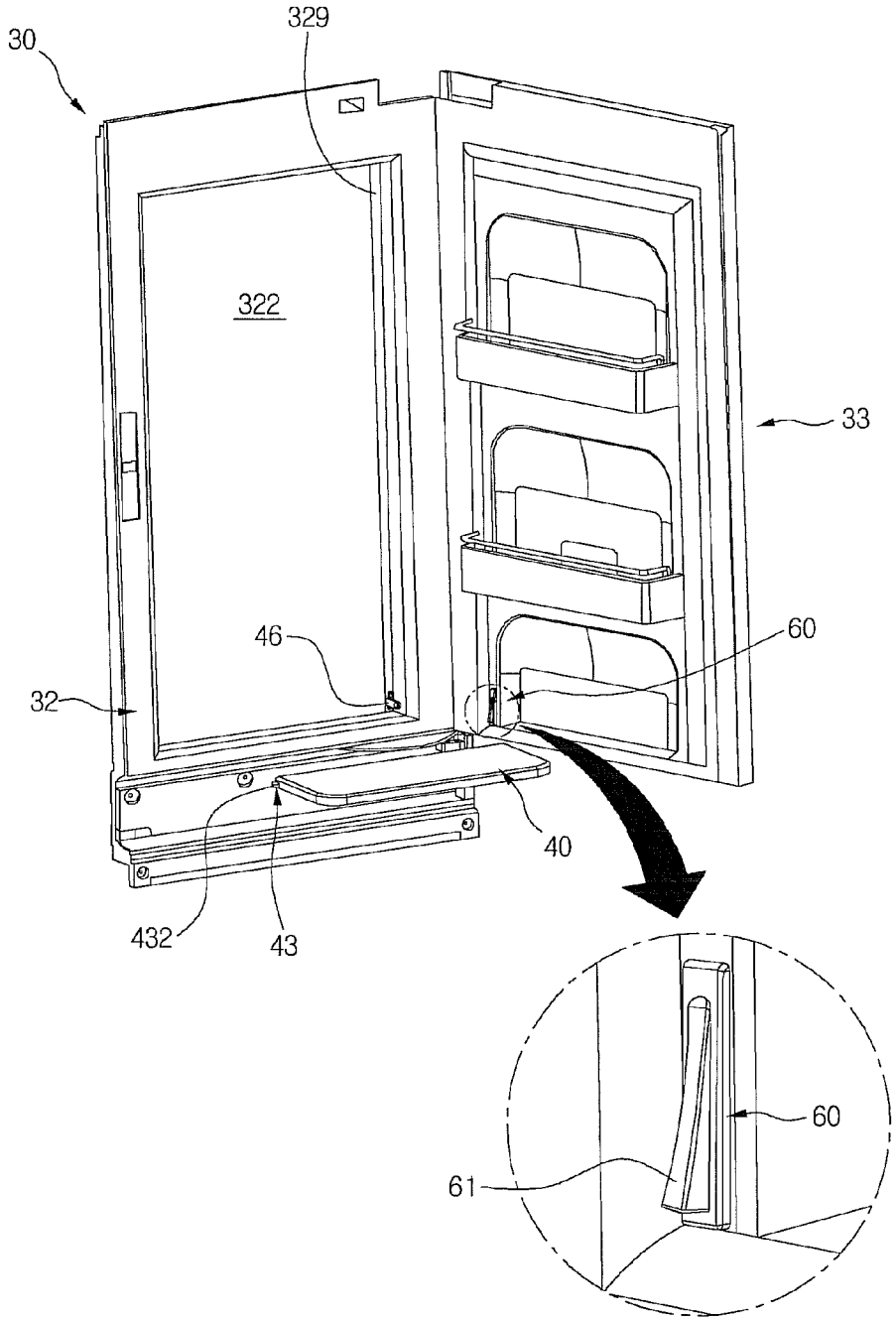
FIG. 13 is a perspective view of a refrigerator with a second door thereof opened, according to another embodiment as broadly described herein.
Figure 14:
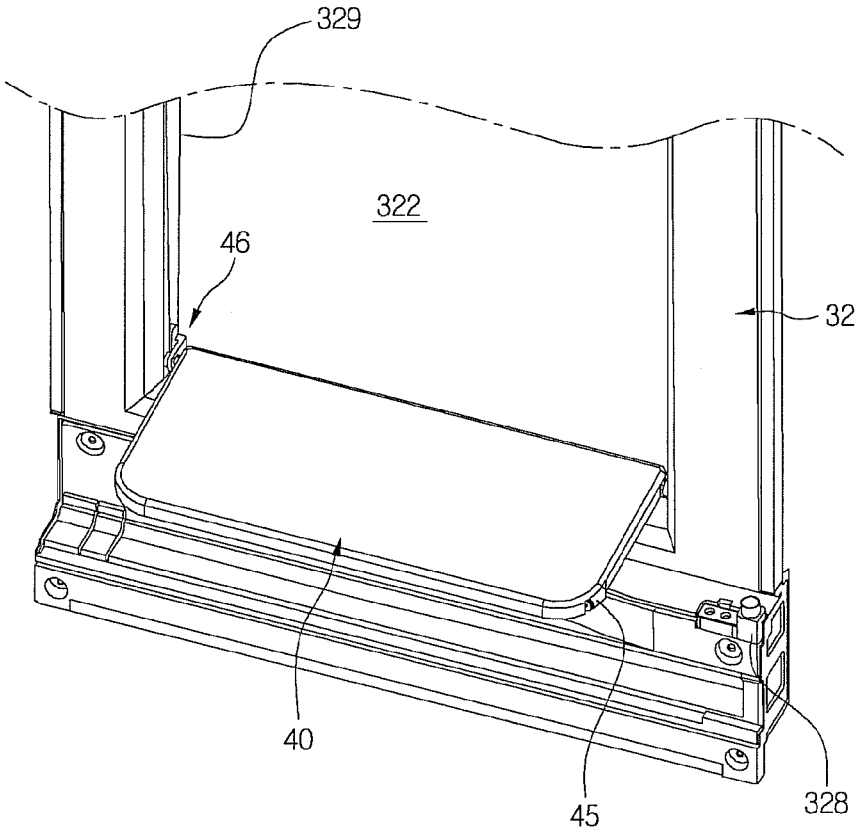
FIG. 14 is a perspective view of an auxiliary shelf in an unfolded state, according to another embodiment as broadly described herein.
Figure 15:
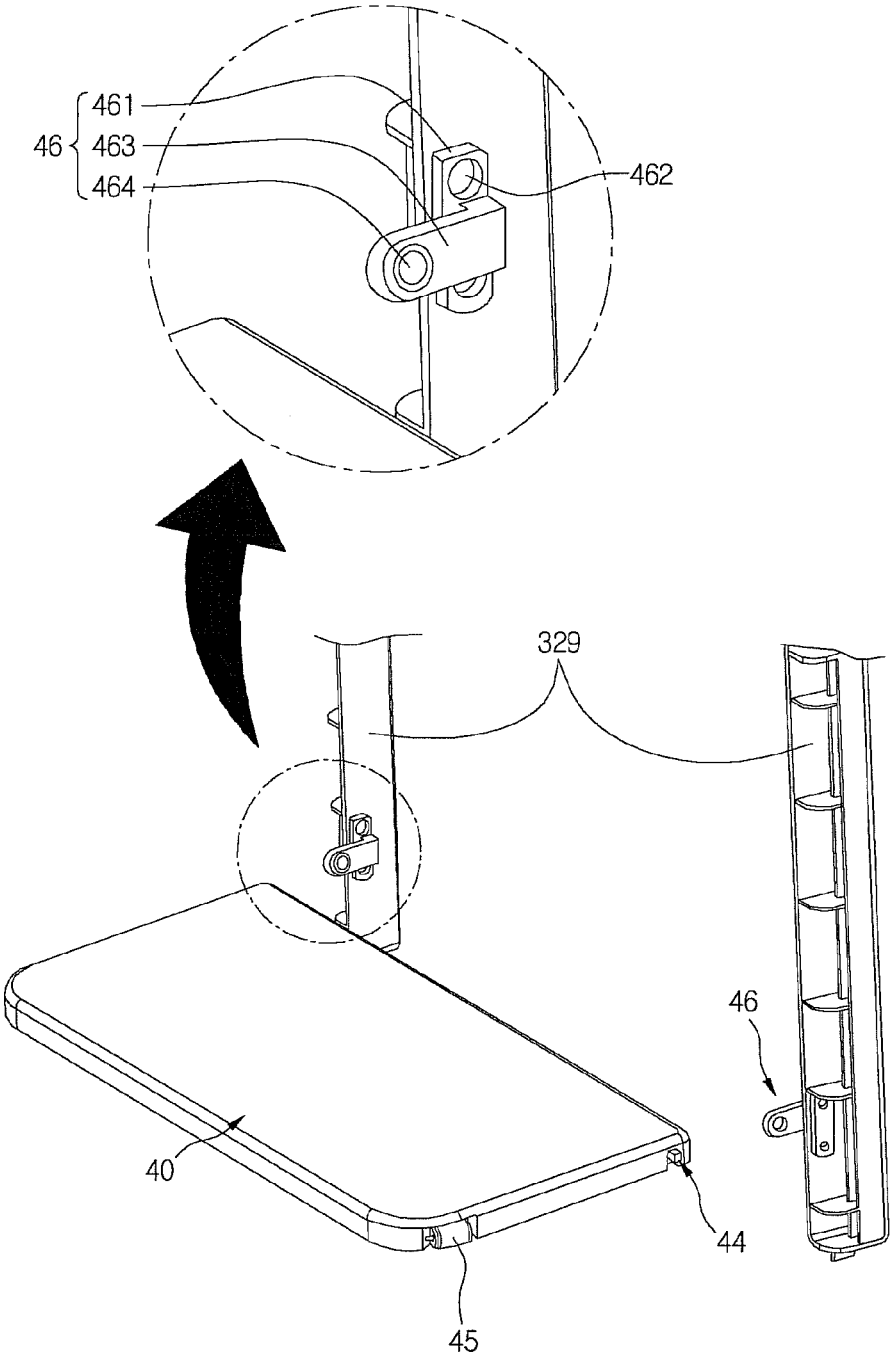
FIG. 15 is an exploded perspective view of a mounting structure of the auxiliary shelf.

FIG. 13 is a perspective view of a refrigerator with a second door opened according to another embodiment, FIG. 14 is a perspective view of the refrigerator shown in FIG. 13, with an auxiliary shelf unfolded, and FIG. 15 is an exploded perspective view of a mounting structure of the auxiliary shelf shown in FIG. 14.

Referring to FIGS. 13 to 15, a refrigerator door 30 according to another embodiment may include a first door 31 and a second door 33. An opening 322 may be defined in the first door 31, and the second door 33 may rotate to open or close the opening 322. An auxiliary shelf 40 interlocked with the opening 322 of the second door 33 may be disposed in the opening 322. Two upper and lower plate-shaped members may be coupled to each other to constitute the auxiliary shelf 40. Alternatively, the auxiliary shelf 40 may be provided as a single plate-shaped member.

A sliding hinge 43 and a damping hinge 44 may be disposed on rear ends of both left and right surfaces of the auxiliary shelf 40, respectively. The sliding hinge 43 may slidably move a hinge shaft 432 by an external manipulation to allow the auxiliary shelf 40 to be easily attached or detached. The damping hinge 44 may provide a force for unfolding the auxiliary shelf 40 when the second door 33 is opened with the auxiliary shelf 40 in a folded position.

A guide roller 45 may be disposed on an edge of the auxiliary shelf 40. The guide roller 45 may contact a shelf guide 60 disposed on a back surface of the second door 33 to allow the auxiliary shelf 40 to smoothly rotate. An opening frame 329 may be mounted at the opening 322, for example, on two opposite side surfaces of the opening 322. A shelf bracket 46 may also be mounted in the opening 322 to allow the auxiliary shelf 40 to be mounted on the opening 322. The shelf bracket 46 may have one side on which hinge shafts 432 and 441 of the auxiliary shelf 40 are mounted and the other side mounted on the opening frame 329.

In detail, the shelf bracket 46 may include a bracket mounting part 461 fixed to the opening frame 329 and a hinge mounting part 463 having a hinge hole 464 in which each of the hinge shafts 432 and 441 may be inserted. A screw hole 462 in which a screw is inserted is defined in the bracket mounting part 461.

The hinge mounting part 463 may extend forward from the bracket mounting part 461 by a predetermined distance to correspond to positions of the hinge shafts 432 and 441. A bushing formed of, for example, an engineered plastic material to allow the hinge shaft 464 to smoothly rotate, may also be provided at the inside of the hinge hole 464.

The positions of the hinge shafts 432 and 441 of the auxiliary shelf 40 may formed to correspond to the shelf bracket 46. The hinge mounting part 463 may be adjusted in length to locate the auxiliary shelf 40 on a rear side of the second door 33 by a sufficient distance so that the auxiliary shelf 40 does not interfere with the back surface of the second door 33 when the second door 33 is fully closed.

The shelf guide 60 may be mounted on the back surface of the second door 33 corresponding to a position of the guide roller 45. The shelf guide 60 may protrude further at a lower side thereof from an upper side thereof. The shelf guide 60 may have an inclined surface 61 contacting the guide roller 45.

The shelf guide 60 may be integrally molded with a door liner defining the back surface of the second door 33 or a portion of the second door 33. Alternatively, the shelf guide 60 may be molded as a separate member and then mounted on the second door 33.

When the second door 33 is closed, the guide roller 45 may contact a lower end of the shelf guide 60, i.e., a lower end of the inclined surface 61. When the second door 33 is further closed, the guide roller 45 may move upward along the inclined surface 61. When the second door 33 is fully closed, the auxiliary shelf 40 may be vertically folded.

When the second door 33 is fully closed, and the auxiliary shelf 40 is folded, the auxiliary shelf 400 may be positioned spaced backward by a sufficient distance to prevent the auxiliary shelf 40 from interfering with the shelf guide 60. For this, the shelf bracket 46 may be disposed so that the hinge shafts 432 and 441 of the auxiliary shelf 40 are disposed on positions nearer to a rear end of the opening 322 than a front end of the opening 322.

In this embodiment, the auxiliary shelf may be unfolded by being interlocked with the opening of the second door. Thus, the user may place items into or withdraw items from the accommodation device and place them on the unfolded auxiliary shelf.

Also, the shelf guide attached to the back surface of the door may provide the inclined surface in the state where the shelf guide protrudes when contacting the guide roller of the auxiliary shelf to allow the auxiliary shelf to smoothly rotate.

Also, when the second door is closed to contact the back surface of the auxiliary shelf, the protrusion portion of the shelf guide may be inserted to minimize a space between the back surface of the auxiliary shelf and the second door in the state where the second door is closed.

Thus, embodiments may provide a structure which smoothly guides rotation of the auxiliary shelf in a narrow space between the back surface of the auxiliary shelf and the second door when the auxiliary shelf rotates and prevents the auxiliary shelf from interfering with the second door when the second door is closed after the auxiliary shelf fully rotates.

The hinge bracket on which the auxiliary shelf is mounted may be disposed on the first door. Thus, it may be unnecessary to directly process a hole for accommodating the rotation shaft of the auxiliary shelf. Also, the auxiliary shelf may be rotatably disposed on the first door by the hinge bracket. Thus, the auxiliary shelf may be disposed further away from the back surface of the second door regardless of the width of the opening to secure a space between the auxiliary shelf and the second door in the state where the second door is closed. The shelf guide disposed on the second door may protrude with sufficient inclination and height to prevent the shelf guide from interfering with the second door when the second door is closed.

Embodiments provide a refrigerator in which an opening is defined in a first door for opening or closing a refrigerating chamber or a storage space, a second door opening or closing the opening is provided, and an auxiliary shelf which is unfolded or folded according to an opening or closing of the second door is disposed in the opening.

In one embodiment, a refrigerator as broadly described herein may include a cabinet having an opened front surface, the cabinet providing a first storage region in which a plurality of shelves are vertically disposed, a first door having a second storage region in which a plurality of shelves are vertically disposed and an opening enabling a user to access to the second storage region, the first door being rotatably connected to the cabinet to open or close the first storage region, a second door rotatably connected to the first door so that the second door rotates to open the opening in the same direction as the rotation direction of the first door for opening the first storage region, a first connection member connecting the cabinet to the first door, a second connection member connecting the first door to the second door, an auxiliary shelf connected to a side of the opening to rotate in a direction crossing the rotation direction of the second door when the second door is opened or closed, a guide roller disposed on a side of an edge of the auxiliary shelf; and a shelf guide disposed on a back surface of the second door to guide the opening/closing operation of the auxiliary shelf while being maintained in a contact state with the guide roller within a predetermined section.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet having an opened front surface, the cabinet having a first storage region formed therein;

a first door rotatably coupled to the cabinet to selectively open and close the first storage region, the first door having a second storage region and an opening providing access to the second storage region;

a second door rotatably coupled to the first door so as to selectively open and close the opening formed in the first door, wherein an axis of rotation of the second door is parallel to that of the first door;

an auxiliary shelf rotatably coupled in the opening formed in the first door, wherein an axis of rotation of the auxiliary shelf crosses that of the first door and the second door;

a guide roller provided on a peripheral edge of the auxiliary shelf; and a shelf guide provided on a rear surface of the second door, facing the first door, wherein the shelf guide maintains contact with the guide roller to guide an opening and closing operation of the auxiliary shelf, wherein the shelf guide comprises:

a guide cover mounted on the back surface of the second door and including an inclined surface provided at an upper portion of the guide cover, wherein, when the auxiliary shelf rotates from a folded position to an unfolded position, the guide roller descends along the inclined surface of the guide cover;

a guide lever having an upper end rotatably coupled to the guide cover, the guide lever contacting the guide roller when the second door rotates between an opened and a closed position; and a lever spring supporting a rear side of the guide lever, between the guide cover and the guide lever, and providing an elastic force in a direction in which the guide lever protrudes from the guide cover.

2. The refrigerator according to claim 1, further comprising:

a first connection device that rotatably couples the cabinet and the first door, the first connection device comprising a door hinge connecting an upper portion of the cabinet to an upper portion of the first door, and a second connection device that rotatably couples the first door and the second door, the second connection device comprising:

an upper hinge connecting an upper portion of the first door to an upper portion of the second door; and a lower hinge connecting the first door to a lower portion of the second door.

3. The refrigerator according to claim 1, wherein the first door comprises a stepped surface on a front surface thereof on which the second door is seated, wherein the opening is formed inside the stepped surface and has a size that is less than that of the stepped surface.

4. The refrigerator according to claim 3, further comprising a shelf support that protrudes from and extends laterally along a bottom surface of the auxiliary shelf, wherein, when the auxiliary shelf is unfolded and positioned horizontally, the shelf support contacts the stepped surface defining a lower end of the opening.

5. The refrigerator according to claim 1, wherein the auxiliary shelf is rotatably coupled to a lower end of the opening by at least one horizontally oriented shaft such that the auxiliary shelf rotates about a horizontal axis of rotation.

6. The refrigerator according to claim 1, wherein a width of the auxiliary shelf is less than that of the opening in the first door.

7. The refrigerator according to claim 1, wherein the shelf guide is coupled to a lower portion of the rear surface of the second door by a rotation shaft.

8. The refrigerator according to claim 7, wherein the guide roller is provided on an edge of a front end of the auxiliary shelf, at a position corresponding to the rotation shaft that couples the shelf guide and the second door.

9. The refrigerator according to claim 8, wherein, as the second door rotates relative to the first door, the guide roller is configured to vertically roll along a front surface of the shelf guide.

10. The refrigerator according to claim 1, wherein the guide cover is provided as a portion of a door liner that forms the back surface of the second door, or the guide cover is provided separate from and coupled to the back surface of the second door.

11. The refrigerator according to claim 1, further comprising:

a sliding hinge provided at one of a left side or a right side of the auxiliary shelf to detachably couple the auxiliary shelf to a corresponding side of the opening in the first door; and a damping hinge provided at the other of the left side or the right side of the auxiliary shelf to apply a force to the auxiliary shelf causing the auxiliary shelf to rotate in a direction in which the auxiliary shelf is horizontally unfolded.

12. The refrigerator according to claim 11, wherein the sliding hinge comprises:

a hinge body fixed within the auxiliary shelf;

a hinge shaft protruding from the hinge body, the hinge shaft being inserted into a hinge hole defined in a corresponding side surface of the opening; and a hinge spring elastically supporting the hinge shaft, wherein the hinge spring is compressed or extended to allow the hinge shaft to move in a direction parallel to the axis of rotation of the auxiliary shelf to insert the hinge shaft into or separate the hinge shaft from the hinge hole.

13. The refrigerator according to claim 11, wherein the damping hinge comprises:

a hinge shaft having one end inserted into a hinge hole defined in a corresponding side surface of the opening;

a fixed cam fixed to the other end of the hinge shaft to rotate together with the hinge shaft;

a movable cam contacting a cam surface of the fixed cam to move in a direction parallel to the axis of rotation of the auxiliary shelf in response to rotation of the fixed cam; and a hinge spring that is contracted or extended in response to movement of the movable cam.

14. The refrigerator according to claim 13, wherein, when the auxiliary shelf rotates in a direction in which the auxiliary shelf is folded, the hinge shaft and the fixed cam rotate in a first direction corresponding to the rotation direction of the auxiliary shelf, and when the fixed cam rotates, the movable cam moves in a direction in which the hinge spring is pressed along a profile of the cam surface of the fixed cam.

15. The refrigerator according to claim 14, wherein, when the second door is rotated to an open position relative to the first door, the movable cam moves in a direction in which the hinge spring is extended by an elastic force thereof, and the fixed cam contacting the movable cam rotates in a second direction opposite the first direction to unfold the auxiliary shelf.

16. The refrigerator according to claim 1, further comprising a pair of shelf brackets respectively to two opposite side surfaces of the opening, wherein the auxiliary shelf is rotatably connected to the opening by the pair of shelf brackets.

17. The refrigerator according to claim 16, further comprising a pair of opening frames respectively fixed to the two opposite side surfaces of the opening, wherein the pair of shelf brackets are fixed to the pair of opening frames, respectively.

18. The refrigerator according to claim 16, wherein each of the shelf brackets comprises:

a bracket fixed to the opening; and a hinge mount extending frontward from the bracket, wherein the hinge shaft of the auxiliary shelf is inserted in the hinge mount.

19. A refrigerator, comprising:

a cabinet having an opened front surface, the cabinet having a first storage region formed therein;

a first door rotatably coupled to the cabinet to selectively open and close the first storage region, the first door having a second storage region and an opening providing access to the second storage region;

a second door rotatably coupled to the first door so as to selectively open and close the opening formed in the first door, wherein an axis of rotation of the second door is parallel to that of the first door;

an auxiliary shelf rotatably coupled in the opening formed in the first door, wherein an axis of rotation of the auxiliary shelf crosses that of the first door and the second door;

a guide roller provided on a peripheral edge of the auxiliary shelf; and a shelf guide provided on a rear surface of the second door, facing the first door, wherein the shelf guide maintains contact with the guide roller to guide an opening and closing operation of the auxiliary shelf, wherein the shelf guide comprises:

a guide cover mounted on the back surface of the second door;

a guide lever having an upper end rotatably coupled to the guide cover, the guide lever contacting the guide roller when the second door rotates between an opened and a closed position; and a lever spring supporting a rear side of the guide lever, between the guide cover and the guide lever, and providing an elastic force in a direction in which the guide lever protrudes from the guide cover, wherein the guide cover includes a lever accommodation space defined in a front surface, to accommodate at least a portion of the guide lever, wherein the lever accommodation space comprises an opening or a recess, wherein the auxiliary shelf comprises a primary surface and a secondary surface, and wherein a shelf groove is formed in the secondary surface of the auxiliary shelf to accommodate at least a portion of the guide lever when the second door is in a fully closed position against the first door, wherein the guide cover comprises at least one side hole which is configured to receive a rotation shaft of the guide lever, and wherein the at least one side hole extends by a predetermined length in a length direction of the guide cover.

20. The refrigerator according to claim 19, wherein the primary surface defines a horizontal receiving surface for temporary storage of items when the second door is in a fully open position with respect to the first door and the auxiliary shelf is rotated from a folded position to an unfolded position.

21. The refrigerator according to claim 19, wherein the rotation shaft of the guide lever moves vertically within the at least one side hole to allow the guide lever to move vertically within the guide cover.

22. The refrigerator according to claim 19, wherein, when the rotation shaft of the guide lever is positioned at a lower end of the at least one side hole, a lower end of the guide lever is positioned lower than a lower end of the lever accommodation space, and when the rotation shaft of the guide lever is positioned an upper end of the at least one side hole, the lower end of the guide lever is positioned higher than the lower end of the lever accommodation space.

23. The refrigerator according to claim 19, wherein, when a lower end of the guide lever contacts a lower end of the shelf groove, a force pushing the guide lever upward is applied to the lower end of the guide lever.

24. The refrigerator according to claim 23, further comprising a contact part provided in the shelf groove, wherein a pressing force pushing the lower end of the guide lever upward at an incline is applied to the contact part while the second door is fully closed.

* * * * *